US006286726B1

(12) United States Patent
Marelli

(10) Patent No.: US 6,286,726 B1
(45) Date of Patent: Sep. 11, 2001

(54) MANUALLY OPERATED PUMP FOR DISPENSING LIQUIDS UNDER PRESSURE

(75) Inventor: Andrea Marelli, Rozzano (IT)

(73) Assignee: Microspray Delta S.p.A., Fizzonasco di Pieve Emanuele (IT)

( * ) Notice: Subject to any disclaimer, the term of this patent is extended or adjusted under 35 U.S.C. 154(b) by 0 days.

(21) Appl. No.: 09/505,631

(22) Filed: Feb. 16, 2000

(30) Foreign Application Priority Data

Mar. 3, 1999 (IT) ..... MI99A0433

(51) Int. Cl.[7] ..... B65D 88/54

(52) U.S. Cl. ..... 222/321.7; 222/321.2; 222/341

(58) Field of Search ..... 222/523, 402, 222/384, 385, 383.1, 321.7, 321.9, 321.2, 341

(56) References Cited

U.S. PATENT DOCUMENTS

| | | | | |
|---|---|---|---|---|
| 6,003,737 | * | 12/1999 | Mascitelli | 222/321.2 |
| 6,036,059 | * | 3/2000 | VanBrocklin | 222/321.9 |
| 6,050,457 | * | 4/2000 | Arnold et al. | 222/321.9 |
| 6,170,713 | * | 1/2001 | Schultz | 222/321.2 |

* cited by examiner

*Primary Examiner*—Kevin Shaver
*Assistant Examiner*—M A Cartagena
(74) *Attorney, Agent, or Firm*—Oblon, Spivak, McClelland, Maier & Neustadt, P.C.

(57) ABSTRACT

A pump for manually dispensing liquids under pressure, including a cup-shaped body, and a stem a piston portion of which defines a compression chamber closed at one end by a valve formed from a ball movable on a seat in a hollow appendix in the interior of a body, and closed at the other end by a valving element movable within a stem bore and having a conical part which can seal against a conical seat in the stem, the pump having a width greater than and a length less than known pumps of equal delivery capacity.

2 Claims, 2 Drawing Sheets

MANUALLY OPERATED PUMP FOR DISPENSING LIQUIDS UNDER PRESSURE

BACKGROUND OF THE INVENTION

1. Field of the Invention

2. Discussion of the Background

A manually operated pump for dispensing liquids under pressure, particularly suitable for use on transparent containers in which the pump body must be as little visible as possible.

Many types of manually operated pumps are known for dispensing pressurized liquids drawn from a container via a unidirectional suction valve and expelled via a discharge valve which is closed when in its rest position and is opened by the liquid which is put under pressure within the interior of the pump when its stem is manually operated or lowered.

In most pumps the suction valve is positioned within an elongate tubular appendix extending outside the main pump body, on this appendix there being mounted one end of a tube through which the pump draws the liquid contained in the container on which the pump is mounted. These pumps have the characteristic of a considerable length compared with the pump transverse dimensions.

U.S. Pat. Nos. 5,503,306 and 5,505,343 describe pumps in which the suction valve is formed from a movable ball housed at the free end of a tubular appendix which extends inside the main pump body, about a hole provided in the base wall of the pump, the ball being able to seal against a seat provided at the free end of this appendix, within the interior of the pump body.

The pumps described in both U.S. Pat. Nos. 5,503,306 and 5,505,343 are formed in such a manner as to expel (when operated) practically all the liquid contained in the pump. For this purpose, as can be clearly seen from the drawings of the two said patents, the pump body must have a very elongate shape, with the piston which forms part of the operating stem of each pump being very long (compared with the general pump dimensions) and tightly sliding along a cylindrical surface (of the fixed pump body) which is also very long, as is also the tubular appendix against the end of which the said ball seals to form the unidirectional valve for drawing the liquid into the pump. The result is that the pumps described in the two cited US patents have a longitudinal dimension much greater than their transverse dimension.

All the aforesaid pumps can be easily used on most containers for liquids to be dispensed, but cannot be mounted on very short containers. Moreover, these pumps are clearly visible by the user when mounted on containers made of transparent material, this being unacceptable for certain uses in which the outer appearance of the container is very important (for example in the quality perfume field), to the extent that the constituent material of the container is often made opaque or coloured or covered with labels or the like to hide the pump body mounted on it.

Many types of discharge valve are also known for enabling the liquid contained in the pump to pass through the pump stem when the pressure of this liquid reaches and exceeds a predetermined value (this to prevent the liquid dripping from the discharge hole in the pump operating head) at the beginning and end of liquid delivery respectively.

In the pumps described in both U.S. Pat. Nos. 5,503,306 and 5,505,343 the discharge valves are formed from a very long cylindrical rod housed and movable within the bore of the stem of the respective pump, in this bore there being provided longitudinal grooves or recesses defining thin longitudinal channels with the opposing surfaces of the said cylindrical rods. Because of their very small cross-section and their relatively large length, said longitudinal channels cause large pressure drops which brake the flow of the liquid in them, to reduce the pressure with which it leaves the bore of the pump stem, with consequent dripping of the liquid from the discharge hole in the pump operating head, both at the beginning and at the end of delivery.

In addition, in the pumps described in the two said US patents, the discharge valve is sealed merely by a portion of its constituent cylindrical rod being simply urged by a spring against a bearing surface provided in a corresponding seat of each stem. The result is both that the seal is very precarious and that the liquid starts to pass through the valve gradually as soon as it begins to open, this passage being very small at the beginning and end of delivery, with consequent further pressure drop and dripping of the liquid from the hole in the operating head.

EP-A-0289856 and U.S. Pat. No. 5,192,006 describe pumps the discharge valves of which consist of a rod housed and movable within the bore of the respective pump stem, this bore having a short cylindrical portion from which longitudinal ribs or grooves extend. A seal lip projects from the rod to sealedly slide along a cylindrical portion of the stem bore, and to open liquid passage only when the lip has moved above said ribs or grooves, in order to enable the liquid to begin to flow out at a pressure greater than that required to cause initial movement of the rod. However even in this case the opening and closure of the discharge valve is initially gradual, with the aforestated drawbacks.

SUMMARY OF THE INVENTION

The main object of this invention is to provide a pump of substantially shorter length than known pumps, to enable it to be used on containers in which the pump presence must be masked or hidden as much as possible, or on very low containers.

A further object is to provide a pump in which the beginning and end of liquid delivery occur without substantial pressure drop, to prevent liquid dripping from the discharge hole in the pump operating head.

A further object is to provide a pump of very simple and low-cost production and assembly.

These and further objects are attained by a pump comprising: a cup-shaped body formed from a lateral wall defining a cylindrical inner surface and a base wall having a hole therein; a hollow stem, of which one end is shaped as a piston sealedly slidable along the cylindrical surface of the cup-shaped body and the other end projects from the cup-shaped body; a pump operating head mounted on that end of the stem projecting from the cup-shaped body and having a discharge hole communicating with the bore of the stem; a mounting element for securing the cup-shaped body to the mouth of a container containing the liquid to be dispensed; a first spring housed in the cup-shaped body and acting on the stem to urge it away from the base wall of the cup-shaped body; a tubular appendix projecting from the base wall of the cup-shaped body about the hole provided in it and extending into the interior of said cup-shaped body; a seat provided at the hole in the base wall of the cup-shaped body to house one end of a liquid intake tube; a profiled seat provided at the free end of said tubular appendix; a floating ball positioned in said profiled seat to sealedly close the bore of the tubular appendix when the pump is operated to dispense the liquid;

and a valving element housed in the stem bore and movable between a rest position in which a profiled portion thereof seals against a corresponding profiled seat provided in the stem bore in proximity to that end thereof facing the cup-shaped body and a delivery position in which the profiled end of the valving element is raised away from said seat in the stem; a second spring inserted into the stem bore and acting on said valving element to urge it into its rest position; that end of the valving element facing the cup-shaped body making contact with said ball to press it into the profiled seat in the tubular appendix before the stem reaches its end-of-travel position when the stem is pressed into the cup-shaped body to compress the liquid contained in it, characterised in that the diameter of the cup-shaped body is at least equal to the length of travel of the stem between its rest position and its position of maximum lowering within the cup-shaped body; the length of said tubular appendix within the cup-shaped body being less than the diameter of said cup-shaped body; and the profiled portion of the valving element and the profiled seat in the stem bore being defined by substantially conical, mutually complementary surfaces.

Preferably, the profiled portion of the valving element is defined by two consecutive adjacent conical surfaces, that conical surface closer to the free end of the valving element having cross-sections smaller than those of the conical surface adjacent to it.

Again preferably, the stem bore has an enlargement in proximity to the profiled seat in the stem bore, the profiled portion of the valving element being positionable with clearance within said enlargement of the stem when this is in the position which it assumes during liquid delivery.

BRIEF DESCRIPTION OF THE DRAWINGS

The pump structure and characteristics will be more apparent from the description of one embodiment thereof given hereinafter by way of non-limiting example with reference to the accompanying drawings, on which.

DESCRIPTION OF THE PREFERRED EMBODIMENTS

Figure 1:
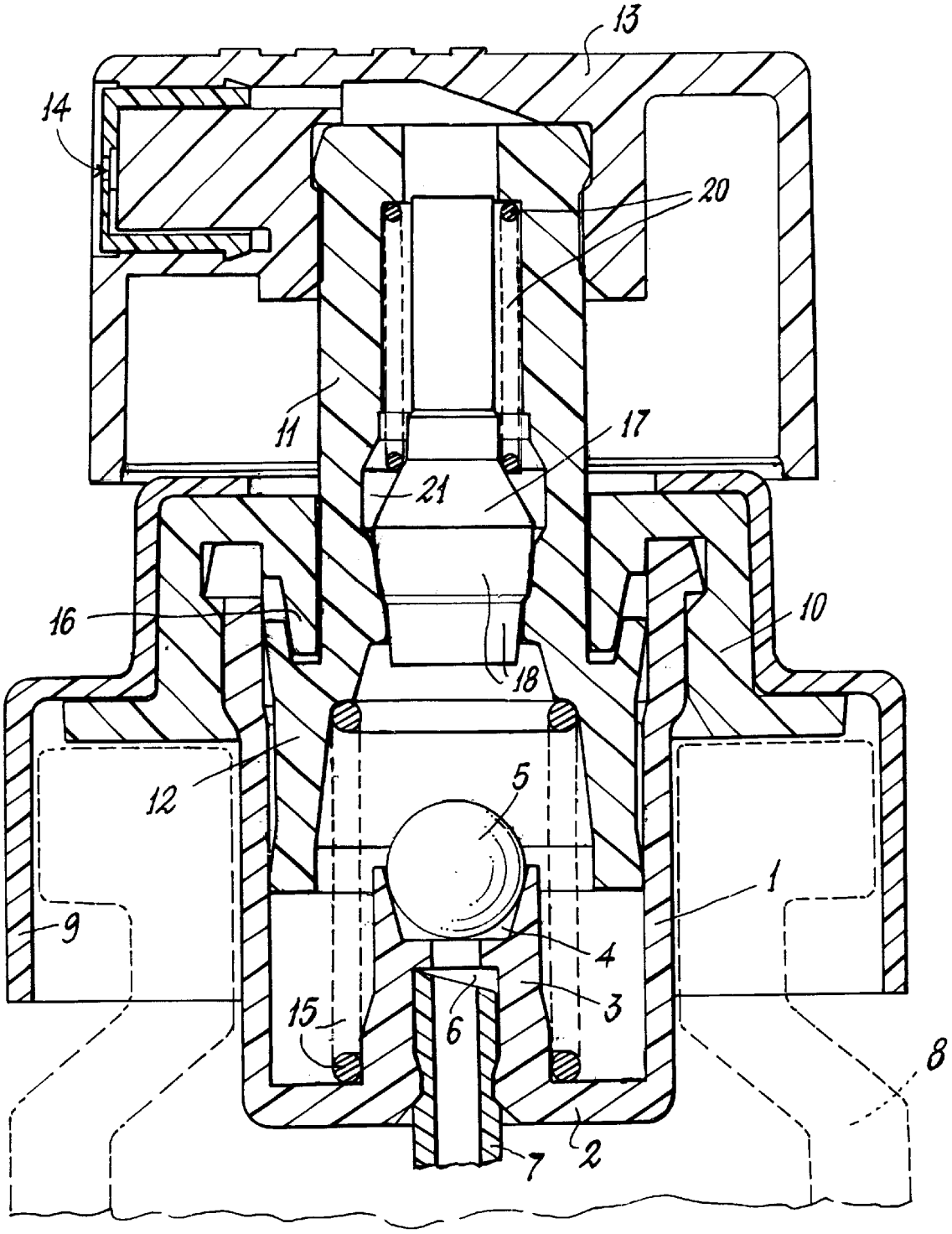
FIG. 1 is an axial section through the pump in its rest position.

As can be clearly seen from the drawings, the pump comprises a cup-shaped body formed from a lateral wall 1 defining a cylindrical inner surface and a base wall 2, in the centre of which there is a hole about which there projects, towards the interior of the cup-shaped body, a tubular appendix 3 with its free end shaped to form a seat 4 for housing a ball 5 in floating relationship, ie movable between the position shown in the figures in which the ball is positioned in its seat to sealedly close the bore in the tubular appendix 3 and a position in which the ball 5 is raised away from the seat 4 to hence leave the bore in said appendix free. At the hole provided in the wall 2 the lower part of the appendix 3 defines a seat 6 for housing one end of a tube 7 through which there can be drawn into the pump interior a liquid contained in a container 8 on which the pump is fixed by a mounting element 9 (consisting for example of a metal ring cap) between which and the cup-shaped body there is inserted a profiled intermediate piece 10 the main purpose of which is to retain a hollow stem 11 in the body 1. This stem 11 has its lower end shaped as a piston 12 which is sealedly slidable along the cylindrical surface of the wall 1 of the cup-shaped body. The other end of the stem 11 projects freely to the outside of the cup-shaped body and on it there is mounted a pump operating head 13 having a hole 14 which is in communication with the bore of the stem and through which the pressurized liquid coming from the pump is discharged into the atmosphere.

Within the interior of the cup-shaped body there is housed a first spring 15 which acts on the stem in the sense of urging it away from the wall 2 of the cup-shaped body. When in the rest position shown in FIG. 1, a lip on the piston 12 is forced (and forms a seal) between the cylindrical surface of the wall 1 and an annular rib 16 projecting from the piece 10.

In the bore of the stem 11 there is housed a valving element 17 the lower end portion of which is shaped to define two consecutive conical surfaces (with that conical surface closer to the lower end of the valving element having smaller cross-sections than the conical surface adjacent to it). The profiled portion 18 of the valving element is positioned in correspondence with a profiled seat 19 provided in the stem bore and against which said profiled portion 18 of the valving element seals when in the rest position (FIG. 1) into which it is urged by a second spring 20 also housed within the stem bore.

It will now be assumed that the pump is in the rest position of FIG. 1 and that the pump chamber, ie the space defined within it by the walls 1 and 2 and by the piston 12, is filled with the liquid to be dispensed.

Figure 2:
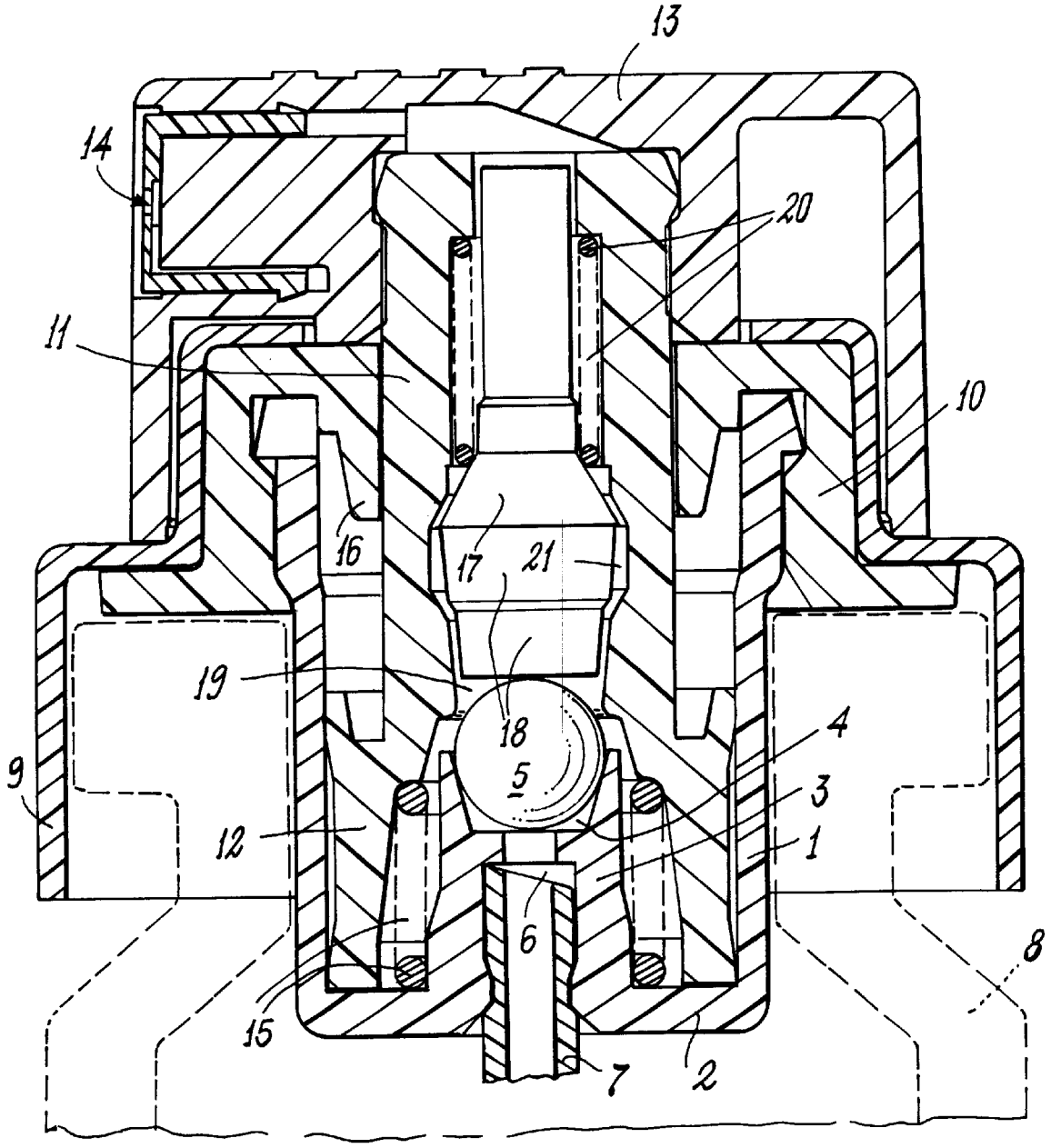
FIG. 2 shows the same pump in its end-of-delivery position.

When the head 13 is pressed, the liquid present in the pump chamber is raised in pressure (the ball is pressed into the seat 4 in the appendix 3 to prevent the liquid flowing back into the container) until this pressure overcomes the thrust of the spring 20, to raise the profiled portion 18 away from the seat 19 in the stem bore, so enabling the liquid to flow with minimum pressure drop along the stem bore and then out of the discharge hole 14 in the head 13 (as is apparent from an examination of FIG. 2).

It is important to note that the conical surfaces of the valving element and of the profiled seat in the stem bore not only provide excellent sealing when in the closed position but also result in immediate freeing of a relatively large passage for the pressurized liquid as soon as the valving element begins to rise against the thrust of the spring 20. Liquid passage with minimum resistance is also favoured by the fact that in proximity to the profiled portion 18 of the valving element the stem bore has an enlargement 21 into which the profiled portion 18 of the valving element becomes positioned as soon as it rises away from the profiled seat in the stem bore.

The aforesaid explains why at the beginning and end of liquid delivery the opening in the discharge valve (formed by the valving element and the stem) becomes immediately of relatively large area, and why it likewise rapidly closes, to prevent dripping of liquid from the hole 14 in the head 13.

As already stated, the profiled portion of the valving element is defined by two consecutive conical surfaces connected together by a step clearly visible on the drawings. That conical part of greater diameter is such that when under rest conditions (FIG. 1) it fits (under the thrust of the spring 20) into the conical seat in the stem, which is constructed of deformable plastic material. It follows that when the pump is operated, the discharge valve snap-opens when the conical part 18 of greater diameter is released from the adjacent surface of the seat in the stem, so that liquid begins to flow suddenly on attaining a pressure greater than that required to overcome the thrust of the spring 20.

As fundamental characteristics of the pump, the diameter of the wall 1 of the cup-shaped body is at least equal to (but preferably greater than) the length of travel of the stem between its rest position (FIG. 1) and its position of maximum lowering (that of FIG. 2, in which the valving element interferes with the ball 5, which raises it away from the seat in the stem, to enable the pump to be primed), and the length of the tubular appendix 3 is less than the diameter of the wall 1. By virtue of these characteristics, the pump body is much shorter and wider than known pumps, for equal amounts of liquid delivered by each pump operation.

This enables the pump to be mounted on the mouth of very low or short containers and especially on transparent containers in which the outer appearance is very important, for example high-quality and high-cost perfume containers. The pump body is almost invisible, being almost totally hidden by the element 9 by which the pump is mounted on the mouth of the container 8.

What is claimed is:

1. A manually operated pump for dispensing liquids under pressure, comprising:

a cup-shaped body formed from a lateral wall defining a cylindrical inner surface and a base wall having a hole therein;

a hollow stem, of which one end is shaped as a piston sealedly slidable along said cylindrical surface of said cup-shaped body and the other end projects from said cup-shaped body;

a pump operating head mounted on the end of said stem projecting from said cup-shaped body and having a discharge hole communicating with the bore of said stem;

a mounting element for securing said cup-shaped body to the mouth of a container containing the liquid to be dispensed;

a first spring housed in said cup-shaped body and acting on said stem to urge it away from the base wall of said cup-shaped body;

a tubular appendix projecting from said base wall of said cup-shaped body about said hole provided in said base wall and extending into the interior of said cup-shaped body;

a seat provided at said hole in said base wall of said cup-shaped body to house one end of a liquid intake tube;

a profiled seat provided at the free end of said tubular appendix;

a floating ball positioned in said profiled seat to sealedly close the bore of said tubular appendix when said pump is operated to dispense said liquid;

and a valving element housed in said stem bore and movable between a rest position in which a profiled portion thereof seals against a corresponding profiled seat provided in said stem bore in proximity to that end thereof facing said cup-shaped body and a delivery position in which the profiled end of said valving element is raised away from said seat in said stem;

a second spring inserted into said stem bore and acting on said valving element to urge it into its rest position;

said end of said valving element facing said cup-shaped body making contact with said ball to press said ball into said profiled seat in said tubular appendix before said stem reaches its end-of-travel position when said stem is pressed into said cup-shaped body to compress said liquid contained in said cup shaped-body, wherein the diameter of said cup-shaped body is at least equal to the length of travel of said stem between a rest position thereof and a position of maximum lowering thereof within said cup-shaped body;

said length of said tubular appendix within said cup-shaped body being less than said diameter of said cup-shaped body;

the profile portion of said valving element and said profiled seat in said stem bore being defined by substantially conical, mutually complementary surfaces; and wherein said profiled portion of said valving element is defined by a first and second consecutive adjacent conical surfaces, said first conical surface closer to the free end of said valving element having cross-sections smaller than those of said second conical surface adjacent to said first conical surface.

2. A pump as claimed in claim 1, wherein said stem bore has an enlargement in proximity to said profiled seat in said stem bore, said profiled portion of said valving element being positionable with clearance within said enlargement of said stem when this is in the position which is assumes during liquid delivery.

* * * * *